United States Patent [19]

Huber

[11] Patent Number: 4,531,329

[45] Date of Patent: Jul. 30, 1985

[54] LIP SEAL SHROUD

[75] Inventor: Paul W. Huber, Lancaster, N.Y.

[73] Assignee: Dynabrade, Inc., Tonawanda, N.Y.

[21] Appl. No.: 538,505

[22] Filed: Oct. 3, 1983

[51] Int. Cl.[3] ..... B24B 55/06

[52] U.S. Cl. ..... 51/273; 51/17 DR

[58] Field of Search ..... 51/170 R, 170 T, 170 TL, 51/170 MT, 273, 268

[56] References Cited

U.S. PATENT DOCUMENTS

| | | | |
|---|---|---|---|
| 1,062,248 | 5/1913 | Mueller . | |
| 1,623,520 | 4/1927 | Bennington . | |
| 1,800,341 | 4/1931 | Davies . | |
| 1,958,354 | 5/1934 | Stephens | 103/262 |
| 2,000,930 | 5/1935 | DeNagy | 253/134 |
| 2,143,970 | 1/1939 | Blood | 51/170 |
| 2,156,824 | 5/1939 | Toro et al. | 51/170 |
| 2,326,396 | 8/1943 | Schaedler | 121/34 |
| 2,499,933 | 3/1950 | Smul | 51/187 |
| 2,764,852 | 10/1956 | Emmons | 51/170 |
| 2,929,177 | 3/1960 | Sheps | 51/273 |
| 3,594,958 | 7/1971 | Cusumano | 51/170 |
| 3,638,362 | 2/1972 | Stoll | 51/170 |
| 3,785,092 | 1/1974 | Hutchins | 51/170 |
| 3,815,292 | 6/1974 | Hutchins | 51/170 |
| 3,827,194 | 8/1974 | Hutchins | 51/170 |
| 3,840,976 | 10/1974 | Hutchins | 29/445 |
| 3,854,206 | 12/1974 | Hutchins | 30/368 |
| 3,862,521 | 1/1975 | Isaksson | 51/273 |
| 3,932,963 | 1/1976 | Hutchins | 51/170 |
| 3,932,966 | 1/1976 | Stern | 51/356 |
| 4,052,824 | 10/1977 | Hutchins | 51/170 |
| 4,058,936 | 11/1977 | Marton | 51/170 |
| 4,145,848 | 3/1979 | Hutchins | 51/170 |
| 4,302,910 | 12/1981 | Tschacher | 51/170 |
| 4,355,487 | 10/1982 | Maier et al. | 51/170 |

*Primary Examiner*—Roscoe V. Parker

*Attorney, Agent, or Firm*—Bean, Kauffman & Bean

[57] ABSTRACT

An exhaust shroud adapted for mounting on the casing of a portable sanding machine is provided with a resiliently deformable lip arranged to engage with a surface of a driven sanding member or workpiece outwardly of such member in such a manner as to provide for an effectively controlled, vacuum induced flow of dust generated by a sanding operation into the shroud, while at the same time not producing a vacuum induced braking effect on movements of the sanding member or movements of the machine relative to the workpiece.

14 Claims, 4 Drawing Figures

Fig. 1.
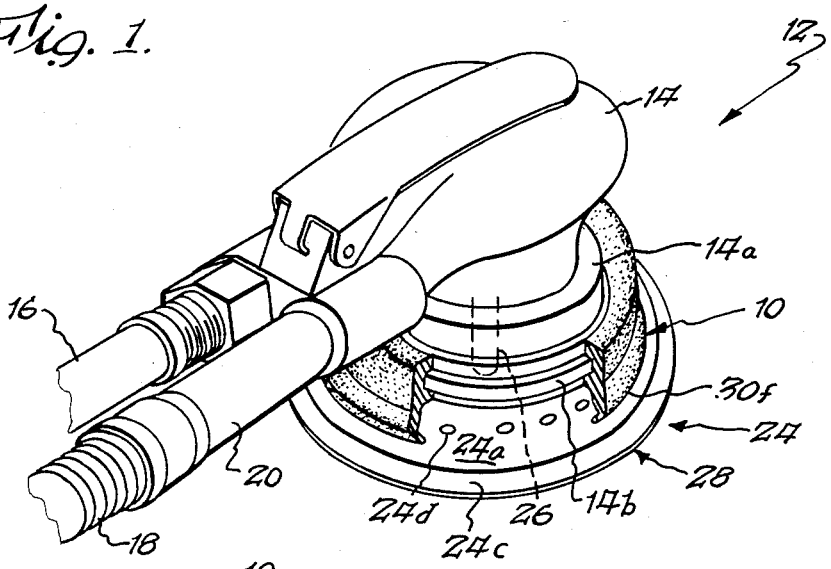
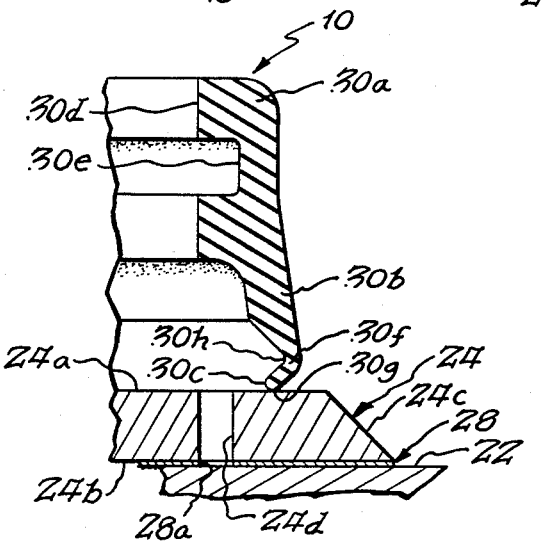
Fig. 2.
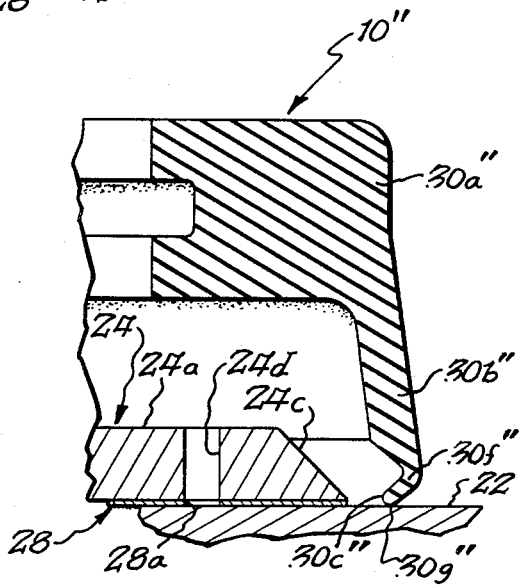
Fig. 4.
Fig. 3.
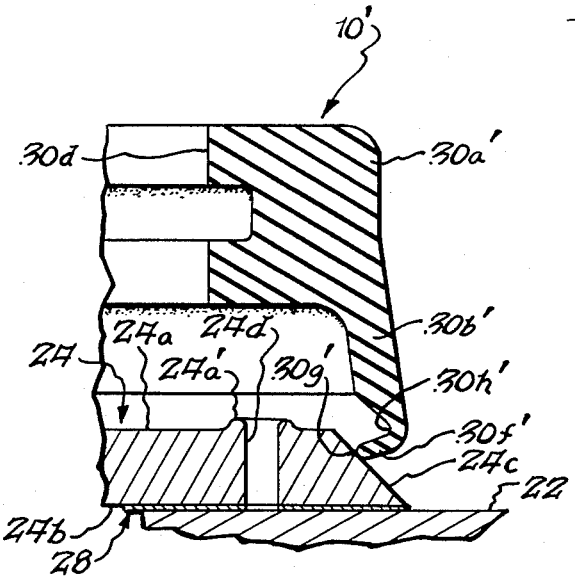

LIP SEAL SHROUD

BACKGROUND OF THE INVENTION

Various attempts have been made to fit portable sanding or like machines with vacuum exhaust shrouds for purposes of collecting dust generated during a sanding or other dust generating operation. As by way of example, U.S. Pat. Nos. 1,800,341 and 4,145,848 propose the use of shrouds having means arranged to engage with or seal against a rear surface of a rotary sanding member or pad formed with vacuum exhaust apertures affording flow communication with the working or sanding surface of such member. Further, it has been proposed for instance in U.S. Pat. Nos. 2,000,930 and 3,785,092 to provide shrouds having means to engage with the surface of a workpiece in order to provide a constricted dust laden air flow path disposed peripherally of the sanding or like member, as well as through exhaust apertures extending between rear and working surfaces of such member where provided therein.

Vacuum exhaust shrouds designed to engage with a sanding member or the surface of a workpiece being sanded by such member have the advantage that the pressure head required to be established by a vacuum source need be relatively small, so as to permit utilization of a relatively inefficient aspirator or an exhaust fan system formed as an integral part of the machine. However, a decided disadvantage of prior shroud constructions of this general type is that when a vacuum head is established, which is sufficient for dust collection purposes, there is a marked tendency for a shroud, particularly when formed of air impermeable resiliently deformable material, to seize or be drawn tightly against the surface with which it operatively engages, so as to retard and in some cases even arrest movement of the sanding member or movement of the machine over the surface of the workpiece.

Still further, as evidenced by U.S. Pat. Nos. 2,156,824 and 2,929,177, various shroud arrangements have been proposed, wherein the lower end portion of the shroud, which defines its inlet opening, is intended to be physically spaced from both the sanding member and the workpiece so as to provide for the unobstructed or free flow of dust laden air peripherally of a sanding member. These shroud constructions suffer from the disadvantage of requiring a large volume of air flow through the shroud, such as to preclude their use with sanding machines relying solely on a built-in aspirator or the like to create a vacuum condition.

SUMMARY OF THE INVENTION

The present invention is directed towards improvements in vacuum exhaust shrouds adapted for use in collecting dust generated during operation of portable sanding or like machines.

More particularly, the present invention is directed towards improved shroud constructions, which provide for efficient dust collection under minimum pressure head conditions, while minimizing or avoiding retardation of movement of a sanding member or movement of a sanding machine over the surface of a workpiece with which the shroud engages.

It is a characteristic of all disclosed forms of the present invention, that a shroud be provided with a resiliently deformable lip positioned to normally engage with a surface defined by either a driven sanding member or a workpiece being sanded, while being supported in a manner preventing such lip from seizing against or being drawn tightly into engagement with such surface, as would otherwise retard or arrest movement of such sanding member or movement of such sanding machine.

BRIEF DESCRIPTION OF THE DRAWINGS

FIG. 1 is a perspective view of a known portable sanding machine showing a shroud formed in accordance with the present invention attached thereto;

FIG. 2 is an enlarged, fragmentary sectional view taken vertically through the shroud shown in FIG. 1;

FIG. 3 is a view similar to FIG. 2, but showing an alternative form of the shroud; and FIG. 4 is a view similar to FIGS. 2 and 3, but showing a further alternative form of the shroud.

DETAILED DESCRIPTION

Reference is first made to FIG. 1, wherein a shroud formed in accordance with the present invention is generally designated as 10 and shown as being mounted on a known, commercially available, portable sanding machine generally designated as 12.

To facilitate description of the present invention, machine 12 will first be generally described as including a casing or housing 14 sized to receive an air motor, not shown, supplied with air under pressure from a suitable source, also not shown, via a supply tube or line 16; air discharged from the air motor being conveyed to a remote point via a discharge tube or line 18. The illustrated sanding machine is of the type provided with a dependent, generally cylindrical casing side wall 14*a* having means, such as an annular rib 14*b* for mounting any desired dust collecting shroud; and a built-in aspirator device 20, which is supplied with or powered by air exhausted from the air motor and serves to create a source of vacuum or a reduced pressure air flow condition available for use in picking up or collecting dust generated during a sanding operation performed on a workpiece 22 by a sanding member 24 suitably driven by the air motor. Sanding member 24 is shown by way of example in FIGS. 1 and 2, as being in the form of a conventional disc shaped sanding pad driven via a drive shaft 26 for rotary or orbital movement and having parallel and essentially planar rear and working or sanding surfaces 24*a* and 24*b*, respectively; a frusto-conically shaped side wall 24*c*; and a plurality of vacuum exhaust apertures or passageways 24*d*, which extend between the rear and working surfaces. Typically, working surface 24*b* would be fitted with a removable sheet of sand paper or the like 28 having apertures 28*a* adapted to be placed in alignment with apertures 24*d*, such that a reduced pressure or vacuum condition established, as by aspirator 20, adjacent rear surface 24*a* will tend to cause dust generated during a sanding operation to be drawn upwardly through the aligned apertures for subsequent conveyance to a suitable collection point through the open lower end of casing side wall 14*a*, aspirator 20 and tube 18.

Reference is now made particularly to FIG. 2, wherein shroud 10 is shown as being in the form of a skirt having a first or upper end portion 30*a* adapted for attachment to machine casing 14 and connection to a suitable vacuum source, such as that established by aspirator 20, and a second or lower end portion 30*b* for providing an inlet opening 30*c* through which dust laden air is drawn for collection purposes. In accordance with a presently preferred form of the present invention, the whole of shroud 10 is fabricated from a suitable resiliently deformable material, and the shroud is removably attached to casing 14 and connected to the vacuum source defined for instance by aspirator 20 by providing first end portion 30*a* with a round mounting and dust discharge opening 30*d*, which is sized to receive casing side wall 14*a*, and an annular mounting groove 30*e*, which is sized to snap-fit receive an annular rib 14*b*. However, the present invention is not limited to the shape of first end portion 30*a* or the mode of mounting thereof, since same will be dependent on the configuration of casing side wall 14*a* or comparable mounting structure provided for any given sanding machine with which a shroud constructed in accordance with the present invention is desired to be employed.

Shroud second end portion 30*b* is shown in FIG. 2 as including a resiliently deformable lip 30*f*, which terminates adjacent its free end in a sealing edge 30*g* extending about or bounding inlet opening 30*c* and is configured such that the sealing edge is positioned relatively inwardly of the juncture of its opposite end 30*h* with an adjacent portion of the shroud. In accordance with the preferred form of the present invention, lip 30*f* has a frusto-conical configuration such that sealing edge 30*g* has a circular plan view configuration.

In the form of the invention illustrated in FIGS. 1 and 2, shroud 10 is shaped and sized such that sealing edge 30*g* is positioned to normally engage throughout the extent thereof with a portion of the planar rear surface 24*a* of sanding member 24 disposed outwardly of apertures 24*d*, when the sanding member is operably engaged with workpiece 22 during a sanding operation, in order to provide an effective air/dust seal between the shroud and sanding member and thus maximize the flow of ambient air upwardly through apertures 24*d* for dust collection purposes. Preferably, the installation of shroud 10 would be such as to insure that lip 30*f* is slightly deformed so as to provide a resilient bias for normally maintaining sealing edge 30*g* in sliding engagement with rear surface 24*a* and accommodating for any lack of parallelism between the sealing edge and such rear surface occasioned for instance by the mounting of the shroud or sanding member or by slight flexures of the sanding member during use.

During a sanding operation, aspirator 20 tends to establish an operating pressure within shroud 10, which is less than the normal atmosphere pressure existing externally of the shroud, and such reduced pressure condition tends to draw air laden with dust generated at the interface between such member or sheet 28 and workpiece 22 upwardly through apertures 24*d* for collection purposes. As a practical matter, the internal/external pressure differential across shroud 10 available for dust collection purposes will vary within some normal operating range depending on many variables such as the efficiency of the aspirator or other vacuum source; the efficiency of the seal, which will vary for instance with the roughness of the rear surface 24*a*; and the size or volume of the flow path available to permit ambient air movement radially inwardly along the working interface between sanding member 24 and workpiece 22, which will in turn vary for instance depending upon grit size of abrasive material employed, roughness of the workpiece and working pressure applied at such interface. The limit of such normal operating range would be proximately established when the pressure differential is sufficient to overcome the resilient bias of lip 30*f*, which will vary depending upon the hardness of the material employed in fabricating shroud 10 and the amount of any initial deformation of the lip required to create a desired seal, that is, when such pressure differential is sufficient to deform lip 30*f* to permit some portion of sealing edge 30*g* to lift or swing up from engagement with surface 24*a*, thereby permitting flow of ambient air into the shroud to reduce the pressure differential to the normal operating range whereupon the resiliency of the lip returns the sealing edge for sealing engagement with the sanding member. By a proper selection of the material from which shroud 10 is fabricated, the thickness and geometry of lip 30*f* and the effective length of the shroud between its mounted end and sealing edge 30*g*, an effective seal can be established, that is, a desired working pressure differential maintained for dust collection purposes, without causing any noticeable braking or motion retarding effect on sanding member 24 or occasioning any undue or rapid wearing away of lip 30*f*. Satisfactory shrouds have by way of example been mold formed from Neoprene of 70 Durometer, Shore A, wherein lip 30*f* is approximately 0.05 inches thick and forms an angle of approximately 45° relative to a longitudinal axis of the shroud.

Reference is now made to FIG. 3, wherein an alternative form of the shroud of the present invention particularly adapted for use with sanding members driven for rotary movement is designated as 10' with primed numerals being employed to designate parts of such shroud similar to those of shroud 10. As will be apparent, shroud 10' is identical to shroud 10 with the exception that its second end portion 30*b'* is shaped such that sealing edge 30*g'* is arranged for sealing engagement with side wall 24*c* of sanding member 24. This construction has utility for use with certain commercially available sanding members, which do not have a planar rear surface or one of sufficient extent to permit sealing thereagainst, due to the presence of surface irregularities, such as raised areas 24*a'* bounding the upper or discharge ends of apertures 24*d*.

Reference is finally made to FIG. 4, wherein a further alternative form of the shroud of the present invention is designated as 10'' with double primed numerals being employed to designate parts of such shroud similar to those of shroud 10. Shroud 10'' may be identical to shroud 10, except that same is shaped and sized to arrange the free or sealing edge 30*g''* of lip 30*f''* for engagement with the surface of workpiece 22 outwardly of sanding member 24, thereby providing an appropriately sized dust laden air flow path disposed peripherally of the sanding member. Since when using shroud 10'', the only source of ambient air available for dust transport purposes is that flowing between lip 30*f''* and workpiece 22, it is not necessary or desirable that its free edge be biased into engagement with the workpiece with that force desirable when same is disposed to engage a sanding member and employed solely to create an air/dust seal. However, the ability of lip 30*f''* to flex, as required to permit lifting of sealing edge 30*g''* against an established bias, is effective in controlling the amount of air entering shroud 10'', while at the same time serving to prevent seizure of the sealing edge against the workpiece, as would otherwise retard or prevent movement of a sanding machine across the surface of the workpiece. An advantage of shroud 10'', as compared to shrouds 10 and 10', is that same can be effectively employed with conventional sanding members not formed with vacuum exhaust apertures.

The term "sanding" as used herein is not intended to be limiting, but rather to include any surface finishing operation in which dust, including dirt, grit or loose particles, are created as a result of operative engagement of a driven member with a workpiece.

The shroud of the present invention has been described with reference to its use in combination with a conventional pneumatic powered sander of the type described for example in U.S. Pat. No. 3,785,092. However, it will be understood that the shroud may be used in combination with diverse sanding machines, such as portable electric or pneumatic powered sanders, whose casings are provided with an air discharge aperture for connection to a separate external vacuum source.

Further, it is contemplated that the shroud of the present invention may also be adapted for use with sanding machines whose casings are not provided with or adapted for connection to a remote vacuum source by the expedient of providing the first end portion of the shroud with a separate discharge opening permitting the shroud to be directly connected to a remote vacuum source.

What is claimed is:

1. An exhaust shroud for connection to a vacuum source for use in collecting dust generated by operation of a sanding machine having a casing supporting a driven member intended to operably engage with a workpiece, said shroud comprising a skirt having a first end portion for attachment to said casing and connection to said vacuum source and a second end portion for providing an inlet opening for collecting dust, said second end portion defining a resiliently deformable lip surrounding said inlet opening and terminating in a free edge positioned to engage with a surface of one of said driven member and said workpiece outwardly of said driven member, when said driven member is operably engaged with said workpiece, and said lip is configured to position said free edge relatively inwardly of the juncture of an opposite end of said lip with said second end portion.

2. A shroud according to claim 1, wherein said skirt is sized to position said free edge for engagement with a rear surface of said driven member spaced from that surface thereof arranged to operably engage with said workpiece.

3. A shroud according to claim 2, wherein said lip has a frusto-conical configuration.

4. A shroud according to claim 1, wherein said skirt is sized to position said free edge for engagement with said workpiece outwardly of said driven member.

5. A shroud according to claim 4, wherein said lip has a frusto-conical configuration.

6. A shroud according to claim 1, wherein said lip has a frusto-conical configuration.

7. A shroud according to claim 6, wherein said shroud is intended for use with a rotary driven member having vacuum exhaust apertures extending between working and rear surfaces thereof and a continuous side wall joining said working and rear surfaces, and said free edge is arranged to engage with said side wall.

8. An exhaust shroud for connection to a vacuum source for use in collecting dust generated by operation of a sanding machine having a casing supporting a motor driven member intended to operably engage with a workpiece, said shroud comprising a skirt formed with a first end portion for attachment to said casing and connection to said vacuum source and a second end portion for providing an inlet opening for collecting dust, said second end portion including a resiliently deformable lip terminating in a sealing edge bounding said inlet opening, and said lip including means for to resiliently biasing said sealing edge to normally engage throughout the extent thereof with a surface defined by one of said driven member and said workpiece to provide an air seal between said skirt and said surface, when said driven member is operably engaged with said workpiece and an internal/external pressure differential established by said vacuum source across said skirt for dust collection purposes lies within a normal operating range, while permitting said pressure differential to overcome said bias and lift said sealing edge from engagement with said surface when said pressure differential exceeds said normal operating range.

9. A shroud according to claim 8, wherein said lip is configured to position said sealing edge relatively inwardly of the juncture of an opposite end of said lip with said second end portion.

10. A shroud according to claim 9, wherein said shroud is intended for use with a driven member having vacuum exhaust apertures extending between generally parallel working and rear surfaces thereof and a portion of said rear surface disposed outwardly of said apertures is planar, and said sealing edge is arranged to engage with said portion of said rear surface.

11. A shroud according to claim 9, wherein said shroud is intended for use with a driven member having vacuum exhaust apertures extending between working and rear surfaces thereof and a continuous side wall joining said working and rear surfaces, and said sealing edge is arranged to engage with said side wall.

12. A shroud according to claim 11, wherein said driven member is further characterized as being supported for rotary movement and said side wall is of frusto-conical configuration tapering inwardly towards said rear surface.

13. A shroud according to claim 8, wherein said lip is of frusto-conical configuration having a relatively large diameter end thereof formed integrally with said skirt and a relatively small diameter end thereof defining said sealing edge.

14. A vacuum exhaust shroud for connection to a vacuum source for use in collecting dust generated by operation of a sanding machine having a casing supporting a driven member intended to operably engage with a workpiece, said shroud having a first end portion for attachment to said casing and connection to said vacuum source and a second end portion defining a resiliently deformable lip of frusto-conical configuration, said lip having a relatively large diameter end joined to said shroud and a relatively small diameter end providing a free edge bounding an opening into said shroud for collecting dust, and said free edge is arranged for engagement with a surface of one of said driven member and said workpiece outwardly of said member, when said driven member is operably engaged with said workpiece.

* * * * *